US007784308B1

(12) United States Patent
Chen

(10) Patent No.: US 7,784,308 B1
(45) Date of Patent: Aug. 31, 2010

(54) YARN FEEDING PLATE DOUBLE-SIDED FLOSS BLOWING APPARATUS FOR CIRCULAR KNITTING MACHINES

(75) Inventor: Shih-Chi Chen, Taipei Hsien (TW)

(73) Assignee: Pai Lung Machinery Mill Co., Ltd., Jui-Fang Town, Taipei Hsien (TW)

( * ) Notice: Subject to any disclaimer, the term of this patent is extended or adjusted under 35 U.S.C. 154(b) by 0 days.

(21) Appl. No.: 12/686,094

(22) Filed: Jan. 12, 2010

(51) Int. Cl.
*D04B 35/32* (2006.01)

(52) U.S. Cl. ..... 66/168

(58) Field of Classification Search ..... 66/8, 66/13, 168; 15/300.1, 301, 316.1, 317, 318
See application file for complete search history.

(56) References Cited

U.S. PATENT DOCUMENTS 4,691,536 A * 9/1987 Yorisue et al. ..... 66/168
5,282,372 A * 2/1994 Gutschmit ..... 66/168
5,408,851 A * 4/1995 Tsuchiya ..... 66/168
5,509,281 A * 4/1996 Tsay ..... 66/168
5,544,504 A * 8/1996 Neher et al. ..... 66/168
6,370,923 B1 * 4/2002 Chol ..... 66/168
7,017,375 B1 3/2006 Chen

FOREIGN PATENT DOCUMENTS

JP 2000-239951 9/2000
JP 3352726 9/2002

* cited by examiner

*Primary Examiner*—Danny Worrell
(74) *Attorney, Agent, or Firm*—Muncy, Geissler, Olds & Lowe, PLLC

(57) ABSTRACT

A yarn feeding plate double-sided floss blowing apparatus for circular knitting machines is installed in a circular knitting machine which includes a needle cylinder to hold a plurality of knitting needles and yarn feeding plates. The floss blowing apparatus comprises an air blowing unit. The air blowing unit includes a first air blowing duct and a second air blowing duct. The first air blowing duct has one end extended above the yarn feeding plates and bent towards a lower half portion of an outer side of the yarn feeding plates to form a first air ejection nozzle. The second air blowing duct has one end extended close to a lower half portion of an inner side of the yarn feeding plates and above the knitting needles to form a second air ejection nozzle. Thus strong airflow can blow away the floss on the yarn feeding plates at the shortest distance.

20 Claims, 5 Drawing Sheets

YARN FEEDING PLATE DOUBLE-SIDED FLOSS BLOWING APPARATUS FOR CIRCULAR KNITTING MACHINES

FIELD OF THE INVENTION

The present invention relates to a floss blowing apparatus and particularly to a floss blowing apparatus for circular knitting machines.

BACKGROUND OF THE INVENTION

During fabric knitting operation of a conventional circular knitting machine, feeding yarns have to be stretched tightly to enhance smooth of the knitting operation. The yarns have to go through various types of motions such as removing, guiding and feeding that incur friction with yarn guiding blades or yarn feeding plates and generate a lot of loose floss. As knitting elements of the circular knitting machine are automatically and regularly sprayed with lubricant or coolant during knitting operation, the fast spinning needle cylinder tends to hit the lubricant or coolant to generate foam type oil sludge adhered to the yarn feeding plates. The dropping floss easily adheres to the smeared yarn feeding plates. If the oil sludge is not cleared regularly, the floss accumulates to become cotton balls to hinder forward operation of the yarns, or even be carried with the yarns to be knitted to become the fabric, and the fabric is formed uneven bulged spots and defects thereon that severely affect fabric quality.

There are many floss blowing techniques disclosed in the prior arts. References can be found in Japan patent No. 2000-239951, Japan patent No. 3352726 and U.S. Pat. No. 7,017,375B1. Japan patent No. 2000-239951 (called the first conventional technique hereinafter) discloses a floss blowing technique (referring to FIG. 4) which blows floss accumulated in yarn guiding apertures of yarn guiding blades on one side from up to down, but does not blow the floss on the vertical yarn feeding plates. Japan patent No. 3352726 (called the second conventional technique hereinafter) discloses another floss blowing technique (referring to FIGS. 1 and 6) which provides a mechanism turning means to blow floss accumulated in the yarn guiding apertures of the yarn guiding blades in a greater range on one side from up to down. It also adopts the same mechanism turning means to blow the floss on yarn feeding plates in a greater range on one side from inner side to outer side, but does not blow the floss on the vertical yarn feeding plates from the outer side towards the inner side. U.S. Pat. No. 7,017,375B1 (called the third conventional technique hereinafter) discloses yet another floss blowing technique (referring to FIGS. 4A and 6) which provides a hose to swingingly blow floss accumulated in the yarn guiding apertures of the yarn guiding blades in a greater range on one side from up to down. It also adopts the same hose to swingingly blow the floss on the yarn feeding plates in a greater range on one side from inner side to outer side, but also does not blow the floss on the vertical yarn feeding plates from the outer side towards the inner side. Moreover, all of the aforesaid three conventional techniques mainly aim to blow the floss from the yarn guiding apertures of the yarn guiding blades. In practice, the floss is most likely to accumulate around the yarn feeding apertures at the outer lower half portion of the yarn feeding plates, namely the final distal end where the yarn is picked up by a knitting needle before knitting the fabric, that causes the floss to be carried with the yarn for knitting and affects the fabric quality. All the aforesaid three conventional techniques, due to their structural and design constraints, do not provide direct floss blowing structure or function to target the outer lower half portion of the yarn feeding plates from outside towards inside. Hence they fail to target the outer lower half portion of the yarn feeding plates where the floss is most likely to be accumulated to provide most direct floss blowing at the shortest distance from the outside towards the inside. In other words, the floss at the final distal end where the yarn is picked up by the knitting needle before knitting the fabric is not blown away. As a result, the accumulated floss often is carried with the yarn picked up by the knitting needle for knitting fabric and creates detects of uneven bulged spots on the fabric that severely affect the fabric quality.

SUMMARY OF THE INVENTION

Therefore, the primary object of the present invention is to overcome the shortcomings of the aforesaid conventional techniques by targeting the lower half portion of outer side and inner side of yarn feeding plates of circular knitting machines that are mostly likely to be adhered and accumulated floss and providing a strong airflow to blow directly and concurrently the inner side and outer side at a shortest distance to render smooth yarn feeding and improve fabric quality knitted by the circular knitting machines without defects, and also reduce heat generated by rotation of the needle cylinder and friction of knitting needles during casting off to increase life span of the needle cylinder and knitting needles.

To achieve the foregoing object, the present invention provides a yarn feeding plate double-sided floss blowing apparatus for circular knitting machines that is installed axially in a circular knitting machine. The circular knitting machine includes a needle cylinder located annularly thereof to hold a plurality of knitting needles, a plurality of yarn guiding apertures and horizontal yarn guiding blades that are located annularly above the needle cylinder, and a plurality of vertical yarn feeding plates. The floss blowing apparatus comprises an axial fixed post fixedly located in the center of the circular knitting machine, a rotation supply unit axially mounted on the fixed post to lead pressurized air into and equipped with a driving motor to drive the floss blowing apparatus to rotate relative to the fixed post and an air blowing unit connecting to the rotation supply unit. The present invention further includes features as follow: the air blowing unit includes a first air blowing duct and a second air blowing duct. The first air blowing duct has one end connected to the rotation supply unit and the other end extended above the yarn feeding plates and bent towards an outer lower half portion of the yarn feeding plates to form a first air ejection nozzle facing directly the outer lower half portion of the yarn feeding plates. The second air blowing duct has one end connected to the first air blowing duct and the other end extended close to an inner lower half portion of the yarn feeding plate and above the knitting needles to form a second air ejection nozzle facing directly the inner lower half portion of the yarn feeding plates.

By means of the structure set forth above, compared with the conventional techniques, the present invention can achieve the following benefits: 1. the present invention ejects strong airflow through the pressurized air at a shortest distance to directly and concurrently target the inner side and outer side of the lower half portion of the yarn feeding plates that are most likely to be adhered and accumulated floss, namely by positioning the first air ejection nozzle and second air ejection nozzle to directly face the final distal end of the knitting needles before a yarn is picked up for knitting fabric while floss has not yet started accumulating, and ejecting strong airflow at two sides concurrently to blow away the floss, the yarn picked up by the knitting needles does not carry accumulated floss to be knitted the fabric; 2. as the first air ejection nozzle directly ejects the strong airflow at a close distance to blow the outer lower half portion of the yarn feeding plates, a substantial residual airflow is stronger than the conventional one to be skewed to enter the needle cylinder to reduce heat of the needle cylinder and knitting needles.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
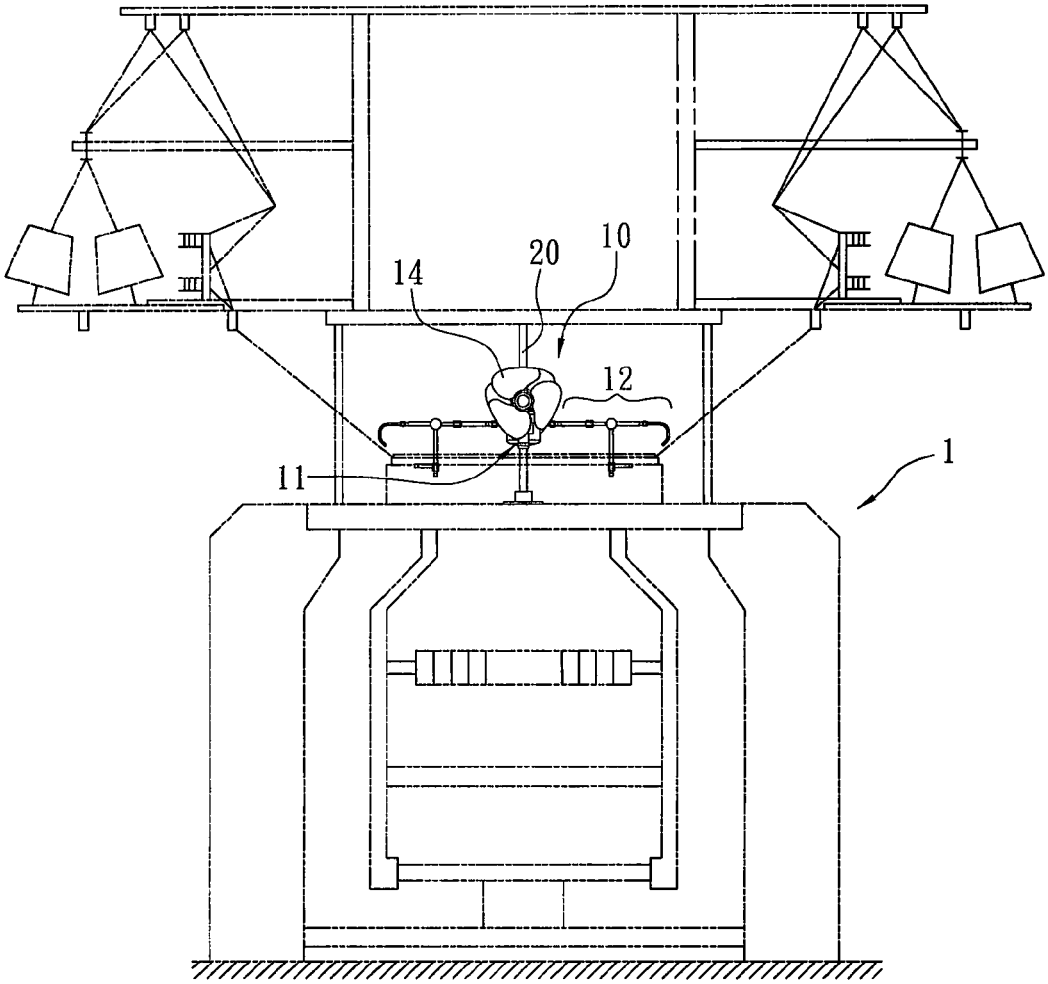
FIG. 1 is a plane view of the floss blowing apparatus of the present invention installed on a circular knitting machine.
Figure 2:
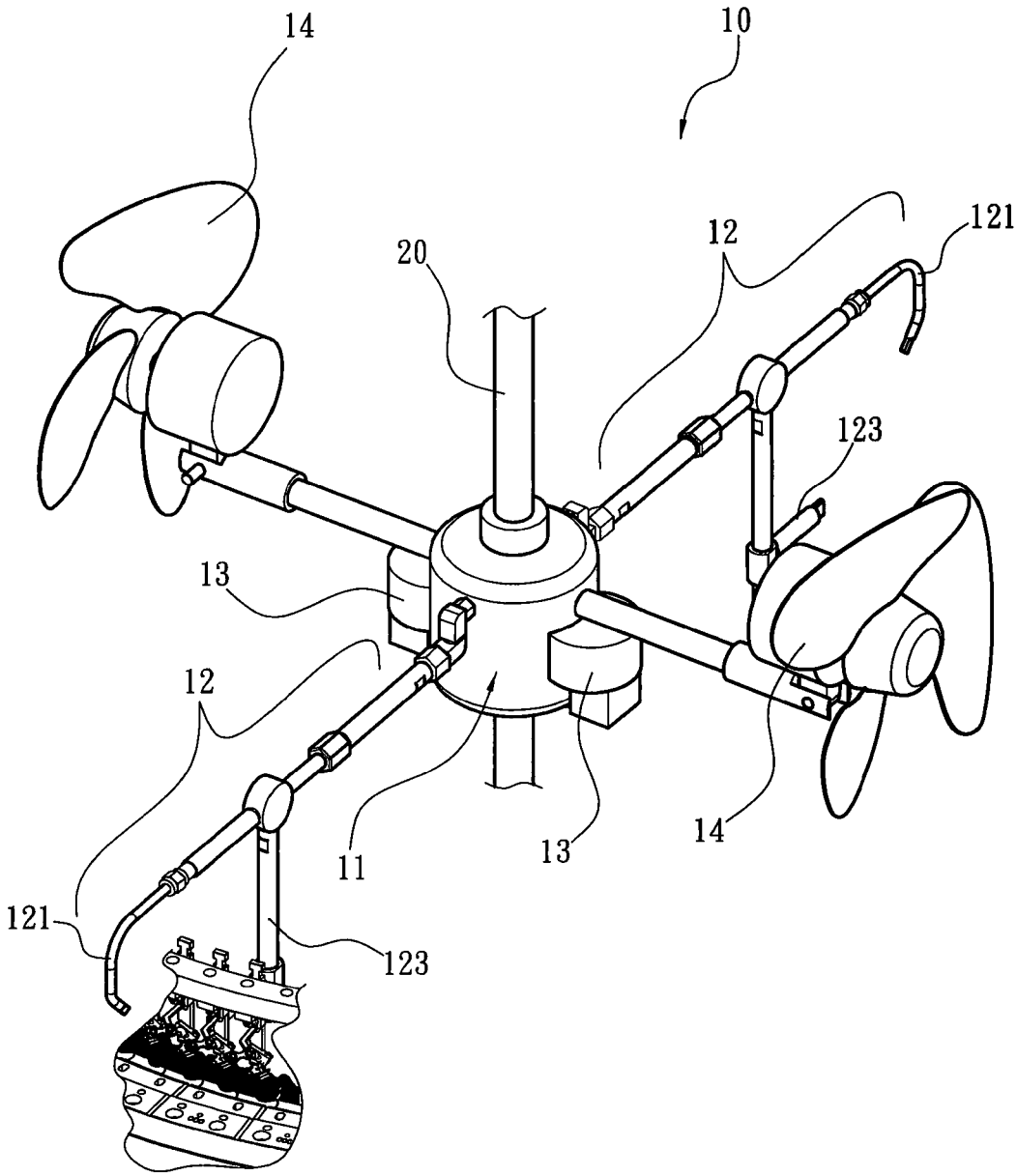
FIG. 2 is a perspective view of the floss blowing apparatus of the present invention.
Figure 3:
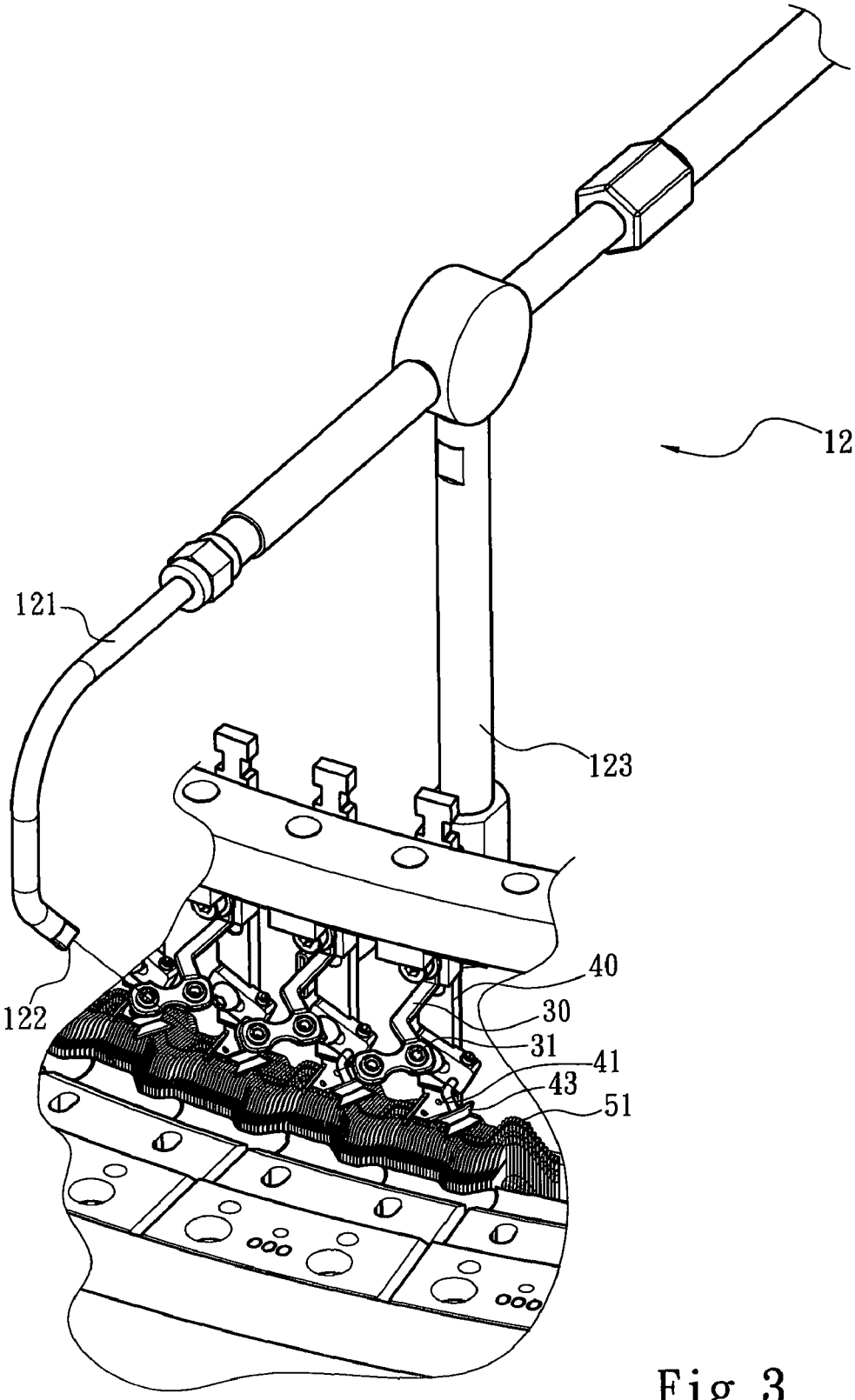
FIG. 3 is a fragmentary enlarged view of the present invention according to FIG. 2.

Please refer to FIGS. 1 through 4 for an embodiment of the yarn feeding plate double-sided floss blowing apparatus for circular knitting machines of the present invention. The present invention provides a floss blowing apparatus 10 axially located in a circular knitting machine 1. The circular knitting machine 1 includes a needle cylinder 50 located annularly thereof which holds a plurality of knitting needles 51, a plurality of yarn guiding apertures 31 and horizontal yarn guiding blades 30 that are located annularly above the needle cylinder 50, and a plurality of vertical yarn feeding plates 40. Each yarn feeding plate 40 has an outer side 44 with a yarn feeding trench 42 formed at the bottom edge of the lower half portion thereof. The lower half portion of the outer side 44 close to the upper side of the yarn feeding trench 42 has at least one yarn feeding aperture 41 running through an inner side 45 of the yarn feeding plate 40. The floss blowing apparatus 10 further includes an axial fixed post 20 fixedly located in the center of the circular knitting machine 1, a rotation supply unit 11 axially mounted on the fixed post 20 to lead pressurized air into and equipped with a driving motor 13 to drive the floss blowing apparatus 10 to rotate relative to the fixed post 20, and an air blowing unit 12 connecting to the rotation supply unit 11. The present invention further includes features as follow: the air blowing unit 12 contains a first air blowing duct 121 and a second air blowing duct 123. The first air blowing duct 121 has one end connected to the rotation supply unit 11 and the other end extended above the yarn feeding plates 40 and bent towards the lower half portion of the outer side 44 of the yarn feeding plates 40 to form a first air ejection nozzle 122 facing directly the lower half portion of the outer side 44 of the yarn feeding plates 40. The second air blowing duct 123 has one end connected to the first air blowing duct 121 and the other end extended close to the lower half portion of the inner side 45 of the yarn feeding plates 40 and above the knitting needles 51 to form a second air ejection nozzle 124 facing directly the lower half portion of the inner side 45 of the yarn feeding plates 40. The second air blowing duct 123 has an airflow regulator 125. The first air ejection nozzle 122 and second air ejection nozzle 124 respectively have elongate inner cross sections to enhance air ejection strength and effective air ejection range. The airflow regulator 125 on the second air blowing duct 123 can adjust the airflow ejected through the second air ejection nozzle 124 to become smaller, then the airflow ejected through the first air ejection nozzle 122 becomes greater. Similarly, when the airflow ejected through the second air ejection nozzle 124 is adjusted greater, the airflow ejected through the first air ejection nozzle 122 is smaller. Thus the airflow regulator 125 can control airflow amount of the first air ejection nozzle 122 or the second air ejection nozzle 124. Moreover, the floss blowing apparatus 10 includes a fan floss blowing unit 14 located on the rotation supply unit 11 that can rotate synchronously with the air blowing unit 12 to delivery air in a greater range.

Figure 4:
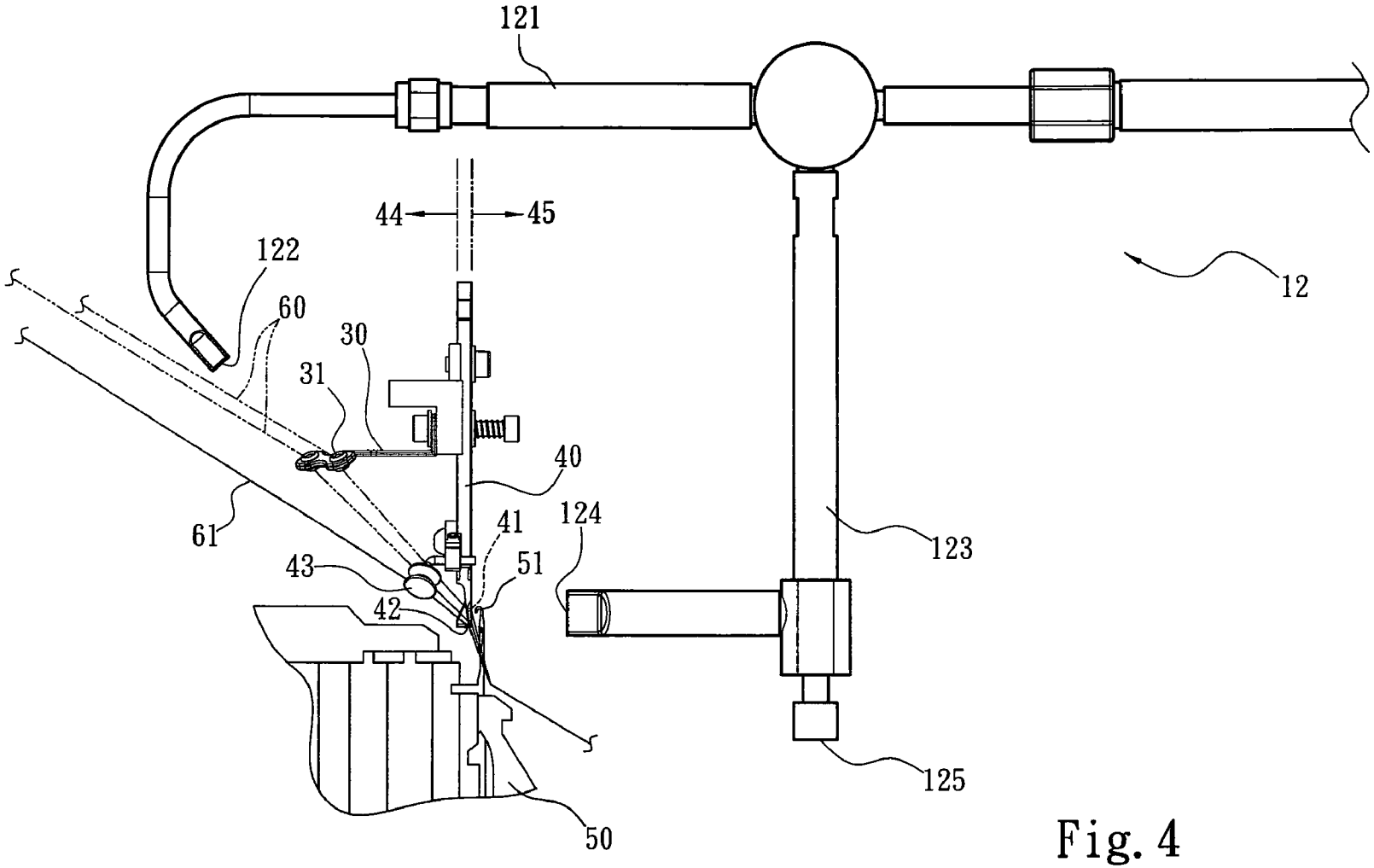
FIG. 4 is a fragmentary enlarged view of the present invention according to FIG. 1.
Figure 5:
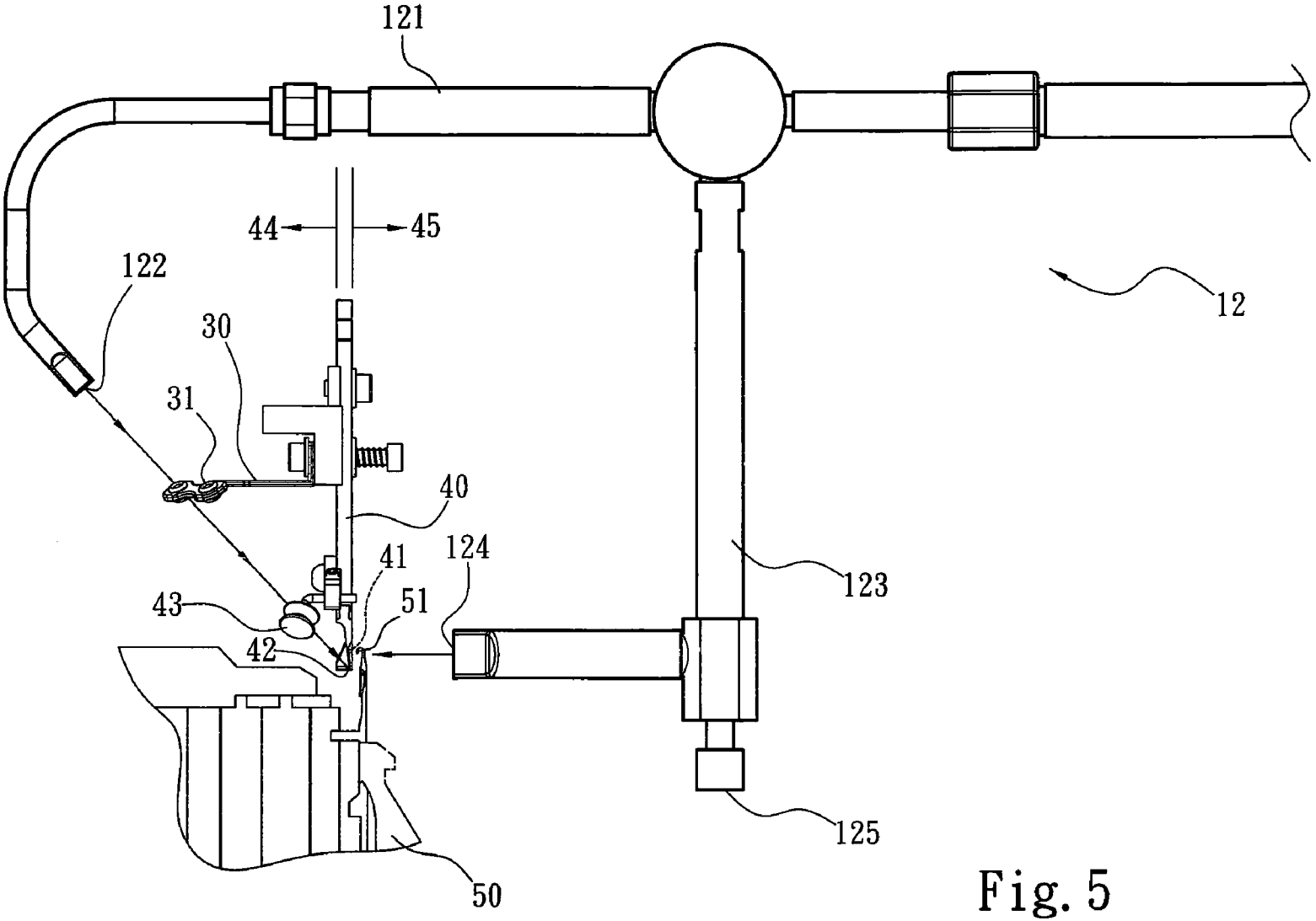
FIG. 5 is a schematic view of the present invention according to FIG. 4 showing the air blowing unit in an air ejecting condition.

Refer to FIGS. 4 and 5 for airflow direction of the air blowing unit 12. It is to be noted that on the circular knitting machine 1, the location most likely to be adhered floss and where the accumulated floss is likely to be carried by the yarn for knitting to affect fabric quality is near the yarn feeding aperture 41 at the lower half portion of the outer side 44 of the yarn feeding plates 40, including the yarn feeding trench 42 at the bottom edge of the lower half portion of the outer side 44 of the yarn feeding plates 40, namely the final distal end of the knitting needles 51 before the yarn is picking up for knitting the fabric. The yarn includes a cotton yarn 60 passing through the yarn guiding aperture 31 and conveyed to the yarn feeding aperture 41 and picked up by the knitting needles 51 for knitting and a synthetic yarn 61 winding on a yarn guiding wheel 43 and conveyed to the yarn feeding trench 42 and picked up by the knitting needles 51 to be knitted together with the cotton yarn 60 to form the fabric. The synthetic yarn 61 can be a Polyurethane Elastomeric Fiber commonly called OP, or a Spandex Yarn, or a Rubber Thread. The reason of the aforesaid locations most likely to be adhered the floss is that during operation of the circular knitting machine 1, friction occurs between the cotton yarn 60 and the yarn guiding aperture 31 and yarn feeding aperture 41 that generates a lot of dropping floss. The dropping floss is easily to be adhered to the yarn feeding plates 40 smeared by oil sludge resulting from automatic and regular spray of lubricant or coolant during operation of the circular knitting machine 1, especially below the yarn feeding aperture 41 of the yarn feeding plates 40 and above the yarn feeding trench 42, namely the lower half portion of the outer side 44 of the yarn feeding plates 40 that is targeted by the present invention. At these locations, not only the dropping floss caused by the friction between the cotton yarn 60 and the yarn feeding aperture 41 is easily attached to the oil sludge, the floss also is easily attached to the synthetic yarn 61 due to the static electricity caused by friction between the synthetic yarn 61 and the yarn guiding wheel 43. When the synthetic yarn 61 passes through the yarn feeding trench 42, the floss is easily to be accumulated on the upper edge of the yarn feeding trench 42. Unless being cleared regularly, the accumulated floss forms cotton balls to hinder feeding of the synthetic yarn 61, or even the cotton balls are carried with the synthetic yarn 61 and picked up by the knitting needles 51 to be knitted into the fabric to form uneven bulged spots and defects thereon that severely affect the fabric quality.

The present invention provides the first air ejection nozzle 122 and second air ejection nozzle 124 to target the outer side 44 and inner side 45 of the lower half portion of the yarn feeding plates 40 where the floss is most likely to be adhered and accumulated to eject strong airflow of the pressurized air directly and concurrently at the shortest distance. The "shortest distance" is that the first air ejection nozzle 122 is located at an upward diagonal position of the yarn guiding aperture 31 facing the lower half portion of the outer side 44 of the yarn feeding plates 40. Hence when the first air ejection nozzle 122 is driven by the rotation supply unit 11 and rotates, it does not hinder the forward direction of the cotton yarn 60 and synthetic yarn 61, and also does not hit the yarn guiding blades 30. The first air ejection nozzle 122 rotates from outside to inside between two neighboring yarn guiding blades 30 to directly blow away the floss at the shortest distance from the lower half portion of the outer side 44 of the yarn feeding plates 40. On the other hand, the "shortest distance" of the second air ejection nozzle 124 is located near the lower half portion of the inner side 45 of the yarn feeding plates 40 and close to the upper side of the knitting needles 51. Hence the second air ejection nozzle 124 can directly eject airflow to blow away the floss at the shortest distance from the lower half portion of the inner side 45 of the yarn feeding plates 40 during rotation. Namely the first and second air ejection nozzles 122 and 124 can directly target the final distal end of the cotton yarn 60 and synthetic yarn 61 before being picked up by the knitting needles 51 for knitting fabric and eject strong airflow synchronously at two sides at the shortest distance to blow the floss away before the floss starts to accumulate. Therefore, the cotton yarn 60 and synthetic yarn 61 can be securely picked up by the knitting needles 51 without carrying accumulated floss during knitting the fabric.

Furthermore, while the first air ejection nozzle 122 ejects strong airflow to blow away the floss from the lower half portion of the outer side 44 of the yarn feeding plate 40, a substantial residual airflow is skewed to enter the needle cylinder 50, adding the fan floss blowing unit 14 which ejects air and blows floss at the same time in a greater range, heat of the needle cylinder and knitting needles can be reduced.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A yarn feeding plate double-sided floss blowing apparatus for circular knitting machines located in a circular knitting machine which includes a needle cylinder located annularly thereof holding a plurality of knitting needles, a plurality of yarn guiding apertures and horizontal yarn guiding blades located annularly above the needle cylinder and a plurality of vertical yarn feeding plates, the floss blowing apparatus comprising:

a fixed post fixedly and axially located in the center of the circular knitting machine;

a rotation supply unit which is axially mounted on the fixed post to lead pressurized air into and includes a driving motor to drive the floss blowing apparatus to rotate relative to the fixed post; and an air blowing unit which is connected to the rotation supply unit;

wherein the air blowing unit includes:

a first air blowing duct which contains one end connected to the rotation supply unit and the other end extended above the yarn feeding plates and bent towards a lower half portion of an outer side of the yarn feeding plates to form a first air ejection nozzle facing directly the lower half portion of the outer side of the yarn feeding plates; and a second air blowing duct which contains one end connected to the first air blowing duct and the other end extended and close to a lower half portion of an inner side of the yarn feeding plates and above the knitting needles to form a second air ejection nozzle facing directly the lower half portion of the inner side of the yarn feeding plates.

2. The yarn feeding plate double-sided floss blowing apparatus of claim 1, wherein the lower half portion of the outer side of the yarn feeding plates includes a bottom side formed a yarn feeding trench.

3. The yarn feeding plate double-sided floss blowing apparatus of claim 2, wherein the lower half portion of the outer side of the yarn feeding plates close to an upper side of the yarn feeding trench includes at least one yarn feeding aperture running through the inner side of the yarn feeding plates.

4. The yarn feeding plate double-sided floss blowing apparatus of claim 3, wherein the second air ejection nozzle includes an airflow regulator.

5. The yarn feeding plate double-sided floss blowing apparatus of claim 4 further including a fan floss blowing unit located on the rotation supply unit.

6. The yarn feeding plate double-sided floss blowing apparatus of claim 4, wherein the first air ejection nozzle and the second air ejection nozzle include respectively an elongate inner cross section.

7. The yarn feeding plate double-sided floss blowing apparatus of claim 2, wherein the second air blowing duct includes an airflow regulator.

8. The yarn feeding plate double-sided floss blowing apparatus of claim 7 further including a fan floss blowing unit located on the rotation supply unit.

9. The yarn feeding plate double-sided floss blowing apparatus of claim 7, wherein the first air ejection nozzle and the second air ejection nozzle include respectively an elongate inner cross section.

10. The yarn feeding plate double-sided floss blowing apparatus of claim 1, wherein the second air blowing duct includes an airflow regulator.

11. The yarn feeding plate double-sided floss blowing apparatus of claim 10 further including a fan floss blowing unit located on the rotation supply unit.

12. The yarn feeding plate double-sided floss blowing apparatus of claim 10, wherein the first air ejection nozzle and the second air ejection nozzle include respectively an elongate inner cross section.

13. The yarn feeding plate double-sided floss blowing apparatus of claim 1, wherein the first air ejection nozzle and the second air ejection nozzle include respectively an elongate inner cross section.

14. The yarn feeding plate double-sided floss blowing apparatus of claim 1 further including a fan floss blowing unit located on the rotation supply unit.

15. The yarn feeding plate double-sided floss blowing apparatus of claim 14, wherein the first air ejection nozzle and the second air ejection nozzle include respectively an elongate inner cross section.

16. The yarn feeding plate double-sided floss blowing apparatus of claim 2 further including a fan floss blowing unit located on the rotation supply unit.

17. The yarn feeding plate double-sided floss blowing apparatus of claim 16, wherein the first air ejection nozzle and the second air ejection nozzle include respectively an elongate inner cross section.

18. The yarn feeding plate double-sided floss blowing apparatus of claim 3 further including a fan floss blowing unit located on the rotation supply unit.

19. The yarn feeding plate double-sided floss blowing apparatus of claim 18, wherein the first air ejection nozzle and the second air ejection nozzle include respectively an elongate inner cross section.

20. The yarn feeding plate double-sided floss blowing apparatus of claim 5, wherein the first air ejection nozzle and the second air ejection nozzle include respectively an elongate inner cross section.

* * * * *